US008640597B2

(12) United States Patent
Hayden et al.

(10) Patent No.: US 8,640,597 B2
(45) Date of Patent: Feb. 4, 2014

(54) ROTATABLE TARGETING ASSEMBLY HAVING WEAPONS INTEGRATED DIRECTION AND RATE CONTROL

(75) Inventors: John Hayden, Aurora, IL (US); Krzysztof Grzyb, Aurora, IL (US); Alyn Brown, North Aurora, IL (US); Nick Scholtes, Shorewood, IL (US); Brett Walach, Montgomery, IL (US)

(73) Assignee: Control Solutions LLC, Aurora, IL (US)

( * ) Notice: Subject to any disclaimer, the term of this patent is extended or adjusted under 35 U.S.C. 154(b) by 640 days.

(21) Appl. No.: 12/533,718

(22) Filed: Jul. 31, 2009

(65) Prior Publication Data

US 2011/0023698 A1 Feb. 3, 2011

(51) Int. Cl.
*F41A 27/00* (2006.01)

(52) U.S. Cl.
USPC ..... 89/41.02; 89/41.01; 89/37.03

(58) Field of Classification Search
USPC ..... 89/41.01, 41.02, 36.03, 36.08, 37.03, 89/41.17; 42/94
See application file for complete search history.

(56) References Cited

U.S. PATENT DOCUMENTS

| | | | | |
|---|---|---|---|---|
| 2,233,918 | A | 3/1941 | Fey | |
| 2,247,842 | A | 7/1941 | Kamenarovic | |
| 2,307,582 | A | 1/1943 | Haberlin | |
| 2,434,653 | A | 1/1948 | Holschuh et al. | |
| 2,509,446 | A | 5/1950 | Oplinger et al. | |
| 2,586,817 | A | 2/1952 | Harris, Jr. | |
| 2,703,039 | A | 3/1955 | White | |
| 2,968,997 | A | 1/1961 | Newton, Jr. et al. | |
| 3,677,134 | A | 7/1972 | Maximi et al. | |
| 4,361,071 | A | 11/1982 | Carlson et al. | |
| 4,576,085 | A | 3/1986 | LeBlanc | |
| 5,353,680 | A | 10/1994 | Tiomkin et al. | |
| 7,030,579 | B1 | 4/2006 | Schmitz et al. | |
| 2007/0119296 | A1 | 5/2007 | Niv et al. | |
| 2008/0034954 | A1 | 2/2008 | Grober | |
| 2012/0144991 | A1 * | 6/2012 | Hayden et al. | 89/41.02 |

OTHER PUBLICATIONS

PCT/US Application No. 1043897—International Search Report and Written Opinion of the International Searching Authority issued Apr. 14, 2011.

* cited by examiner

*Primary Examiner* — J. Woodrow Eldred
(74) *Attorney, Agent, or Firm* — Edwards Wildman Palmer LLP

(57) ABSTRACT

A weapons system includes a frame having an axis. A targeting assembly is arranged and operational to move rotationally the frame axis. The targeting assembly includes a weapon. A user interface is attached to the weapon and is operable actuate movement of the targeting assembly about the axis.

28 Claims, 8 Drawing Sheets

ROTATABLE TARGETING ASSEMBLY HAVING WEAPONS INTEGRATED DIRECTION AND RATE CONTROL

BACKGROUND

Many weapons systems include rotatable weapons turrets. Often these are attached to either a stationary or a mobile frame (e.g. a vehicle). If a turret is heavily armored, it will likely include a motor to rotate the turret in response to operator input. Typically, a turret operator uses a hand controller to adjust the turret to a desired position. A problem exists, however, in that the operator needs a free hand to move the controller. This forces the operator either (1) to fire a weapon with one hand while operating the controller with the other hand (contrary to generally recognized and accepted training principles) or (2) to move the turret into position before achieving a proper firing position. Thus, the operator either loses accuracy, by using only one hand to fire, or encounters delay by having to position the turret before firing.

Accordingly, what is needed is controller that will allow the operator to maintain a sure grip on a weapon, while simultaneously being able to rotate the turret. Further, it would be desirable for such a controller to be retrofittable to existing weapons systems.

Figure 1:
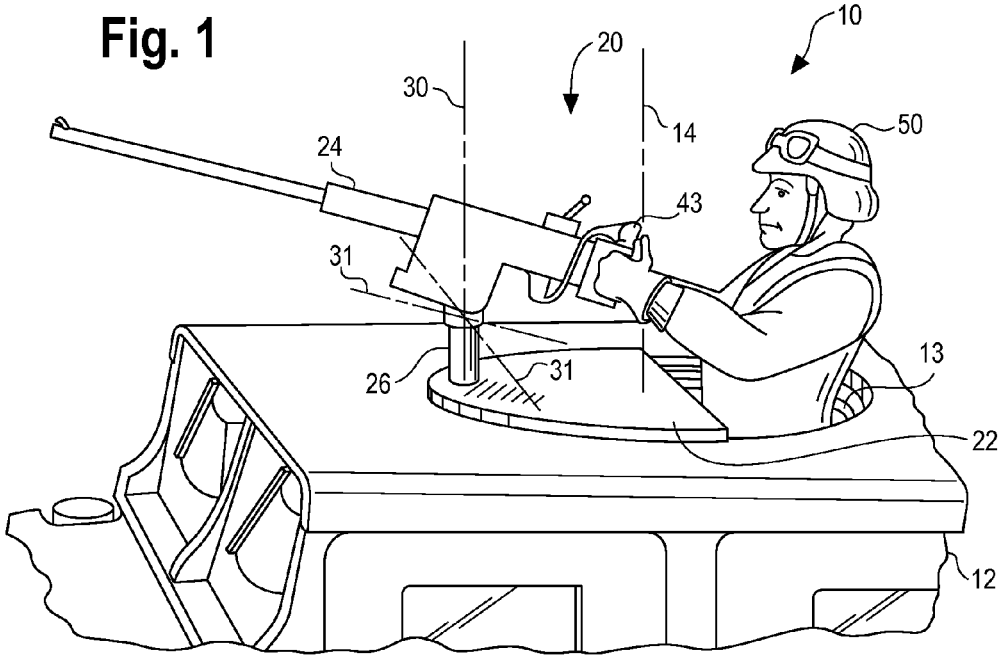
FIG. 1 is a side perspective view of a portion of a vehicle with a motorized targeting assembly.

It should be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is to describe and should not be regarded as limiting.

DETAILED DESCRIPTION

Figure 2A:
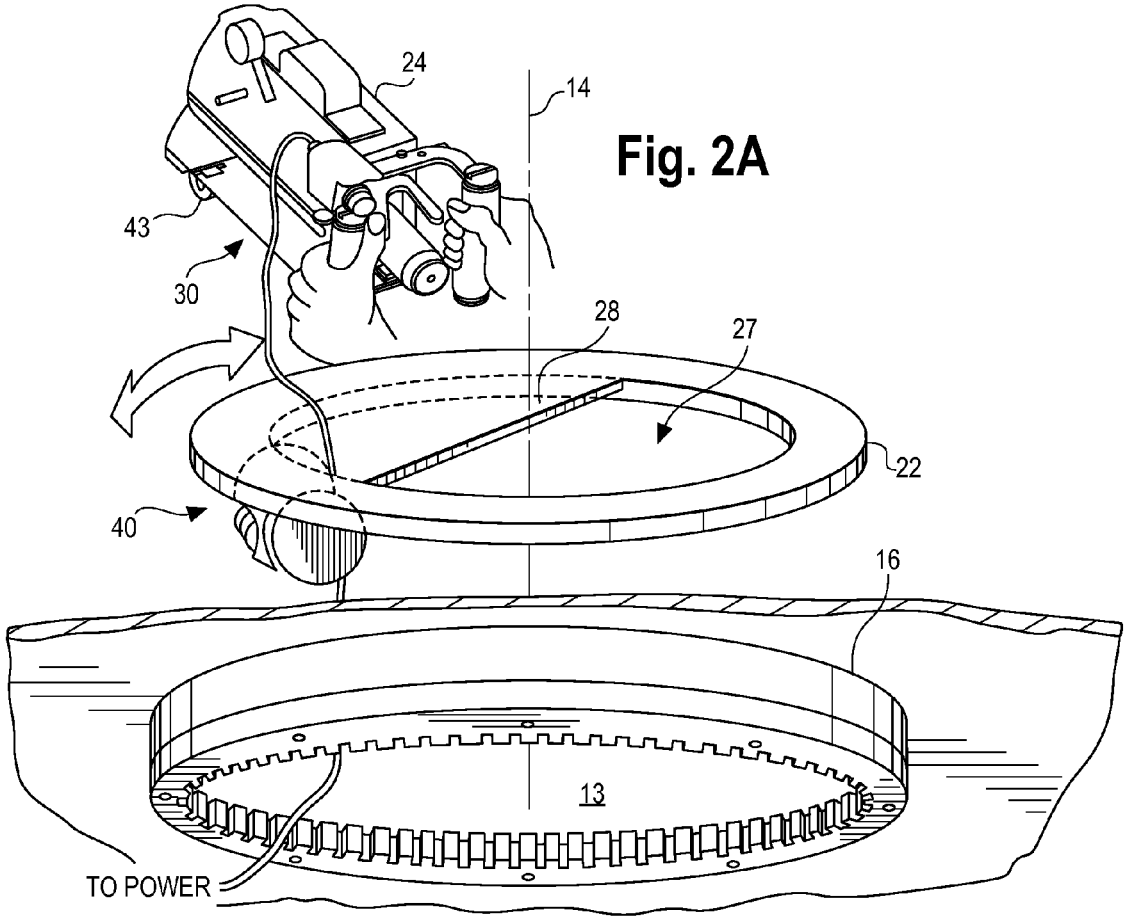
FIG. 2A is an exploded view of the motorized targeting assembly of FIG. 1.

Referring to FIGS. 1 and 2A, a system 10 and operator 50 are shown. In one example, system 10 is a weapons system comprising a frame 12, targeting assembly 20, and control assembly 40 (FIG. 2A).

Frame 12 in the example shown is a vehicle. Frame 12, however, could be a vehicle body, a vehicle frame, or another appropriate structure. In one example, frame 12 is a land based motor vehicle, such as an M-1114 High Mobility Multipurpose Wheeled Vehicle (HMMWV). In another example, frame 12 could be a water based vehicle. Essentially, frame 12 comprises any structure capable of serving as a platform for targeting assembly 20.

Referring further to FIGS. 1 and 2A, frame 12 includes an opening 13 with an axis 14. Targeting assembly 20 is positioned within opening 13 and is arranged for rotation about axis 14. Operator 50 stands or sits within opening 13 and operates targeting assembly 20 in a manner that will be discussed further herein.

Referring further to FIGS. 1 and 2A, targeting assembly 20 in one embodiment comprises body member 22, targeting equipment 24, and mount 26. Body member 22 in one example includes a substantially circular frame capable of fitting within opening 13 and into registration with a drive ring 16 attached to frame 12. Body member 22 includes an opening 27 (for operator 50) and a support surface 28. Targeting equipment 24 is mounted on support surface 28 through employment of mount 26.

Targeting equipment 24 in one example comprises a weapon, such as a .50 caliber machine gun. In another example, targeting equipment 24 comprises another type of weaponry, such as a missile launcher or a rocket propelled grenade launcher. In a further example, targeting equipment 24 comprises non-lethal equipment, such as a fire hose, a light emitting weapon, a sound emitting weapon, and audio and/or visual reproduction equipment. In one example, mount 26 is configured such that targeting equipment 24 is capable of rotating horizontally around axis 30 and rotating vertically around horizontal axes 31.

Figure 2B:
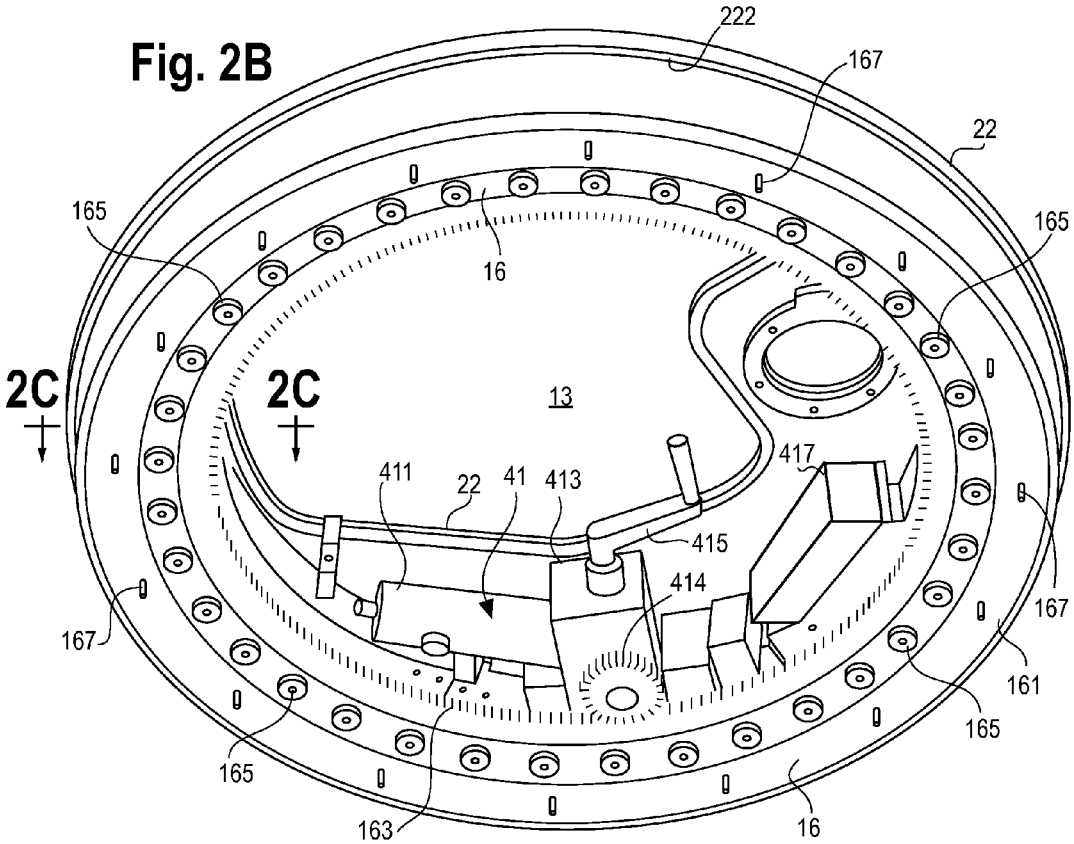
FIG. 2B is an underside perspective view of a prime mover system shown in FIG. 2A.
Figure 2C:
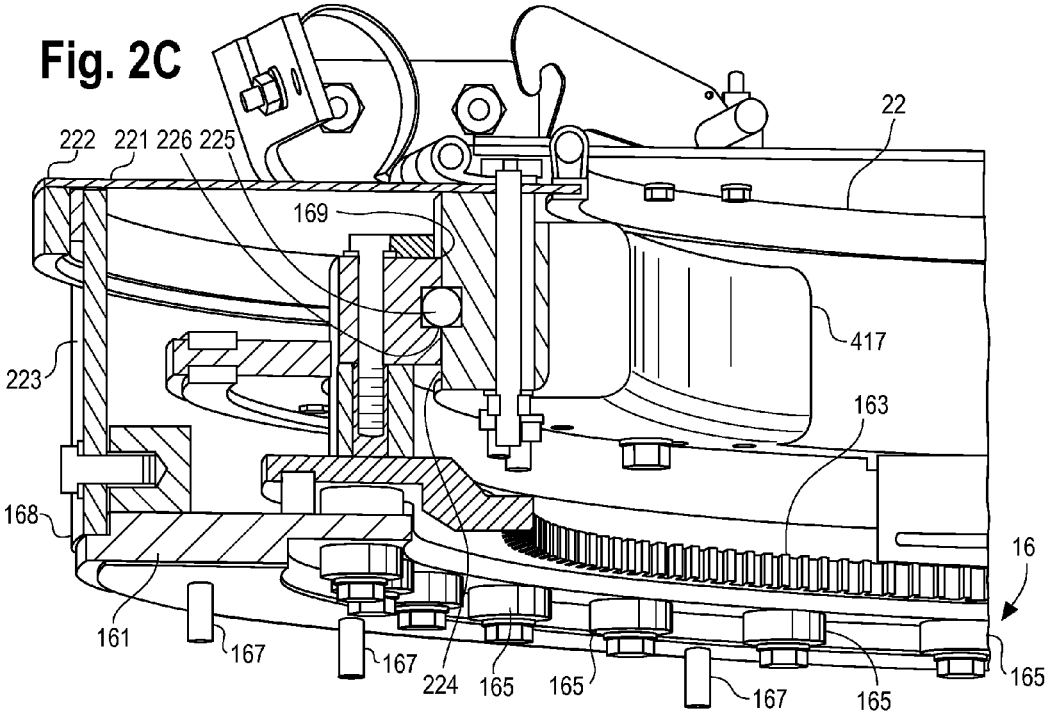
FIG. 2C is a cross-sectional view taken along line 2C-2C in FIG. 2B with a control unit attached thereto.

Referring to FIGS. 2B and 2C, targeting assembly 20 in one example rotates relative to frame 12 through employment of drive ring 16 and body member 22. Drive ring 16 is positioned within opening 13 and secured to frame 12. Alternatively, drive ring 16 could be integrally molded to frame 12 or secured to frame 12 through other connecting means. Drive ring 16 includes a base member 161 and a gear track 163. Gear track 163 is attached to base member 161 through bolts 165 and base member 161 is attached to frame 12 through bolts 167.

Referring primarily to FIG. 2C, body member 22 includes a top surface 221, a ledge 222, and a sidewall 223. Sidewall 223 is positioned in registration with a shelf 168 located on base member 161. Sidewall 222 is adapted to slide with respect to shelf 168, thereby allowing body member 22 to move with respect to drive ring 16.

Continuing to refer primarily to FIG. 2C, drive ring 16 includes an interior bearing surface 169 projecting upward from and attached to gear track 163. Body member 22 also includes an interior bearing surface 224. A recess is formed in each of interior bearing surface 169 and interior bearing surface 224 such that a channel 225 is formed therebetween. Ball bearings 226 are positioned within channel 225 such that the two bearing surfaces 169, 224 can efficiently move with respect to each other.

Referring now to FIG. 2B, electromechanical rotation of targeting assembly 20 will now be described for illustrative purposes. Control assembly 40 in one example comprises a prime mover system 41, attached to body member 22. Prime mover system 41 interacts with drive ring 16 and causes body member 22 to rotate relative to axis 14.

Referring to FIG. 2B, prime mover system 41 is mounted to body member 22 through means, such as bolts, and in one example includes a motor 411, gearbox 413 (including drive gear 414), hand crank 415, and control unit 417. In one example, prime mover system 41 includes a proportional motor control device, such as a battery powered motorized traversing unit ("BPMTU") controller manufactured by Control Solutions LLC of Aurora, Ill.

Motor 411 is utilized to turn drive gear 414 thereby applying a force against gear track 163 and moving body member 22 relative to axis 14. Gearbox 413 holds the gear configuration that translates the movement of motor 411 (and hand crank 415) into rotational movement of drive gear 414. Hand crank 415 is used to manually move drive gear 414 in the event that power is cut or some other electrical malfunction occurs such that prime mover system 41 is no longer capable of being driven by motor 411. Control unit 417 in one example provides proportional control to motor 411. For instance, control unit 417 receives electrical signals from a hand controller, as will now be described herein, and translates those signals into a command to motor 411 to turn in one direction or the other.

Figure 3:
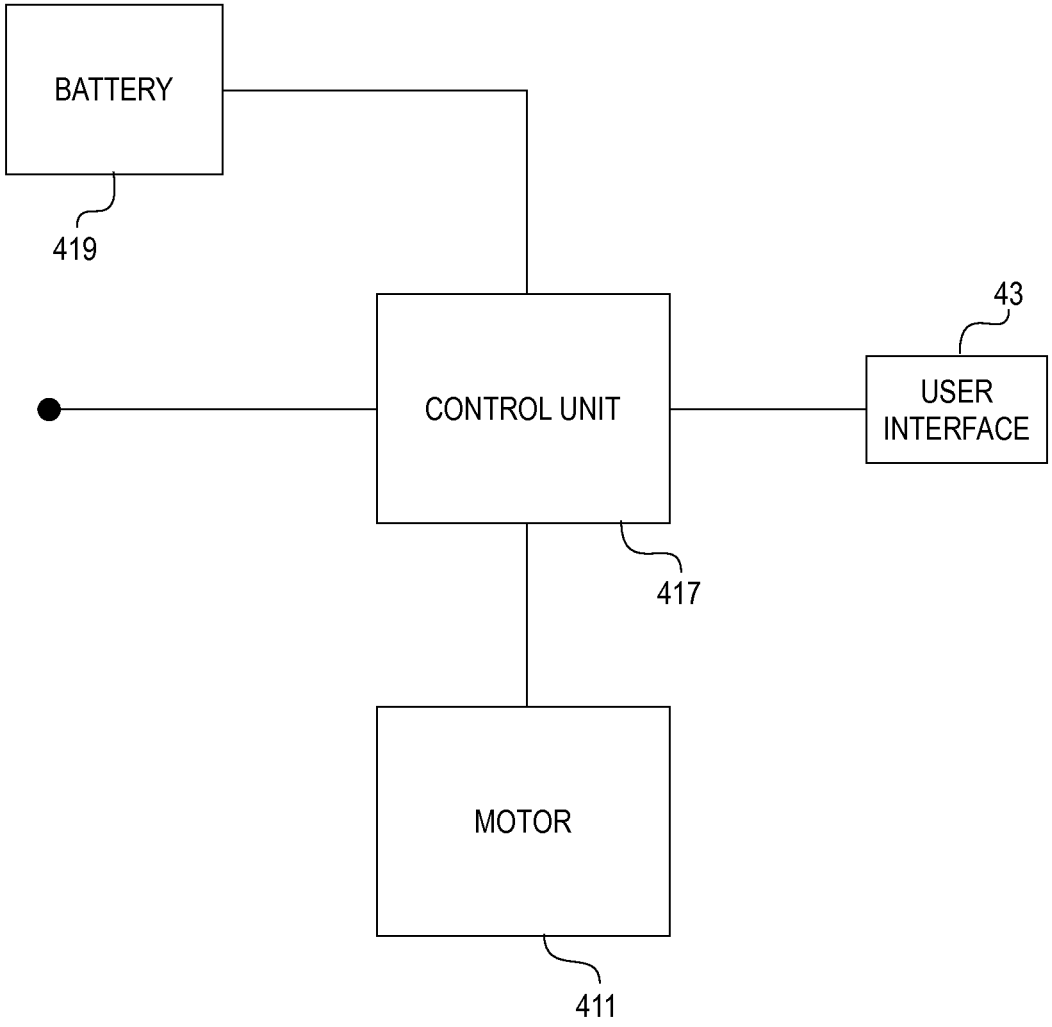
FIG. 3 is functional block diagram of the prime mover system shown in FIG. 2B.

Detailed interconnection of components is not shown in FIGS. 2A-2C to aid in illustration of the major components shown therein. Accordingly, FIG. 3 provides a functional block diagram depicting the electrical connection of the components shown in FIGS. 2A-2C. Referring to FIG. 3, control unit 417 is coupled to motor 411, battery 419, and to user interface 43. In one example, control unit 417 is also electrically coupled to a main power source on frame 12. For instance, if frame 12 is a vehicle, such as a HMMWV, then control unit 417 will be coupled to the main HMMWV power through a wiring harness, such as one that can be coupled to wiring harness with a connector that will separate if targeting assembly 20 rotates more than about 25 degrees from center. Battery 419 allows targeting assembly 20 to continue to rotate if the connector is disconnected. It should be noted that the components of FIG. 3 can be coupled together through wired means, such as cabling, or through wireless means (e.g., WiFi, IrDA, wireless power, etc.)

Referring to FIG. 2A, prime mover system 41 is actuated by user interface 43. User interface 43 in one example is a proportional control input device. User interface 43 is positioned on targeting equipment 24, and is electromechanically coupled, through cable to prime mover system 41. In one example, user interface 43 is attached to prime mover system 41 through electromechanically coupling through a BPMTU interface. By actuating user interface 43, operator 50 can rotate targeting assembly 20 in a clockwise direction or counterclockwise direction about axis 14.

Referring further to FIG. 1, as body member 22 rotates about axis 14, a platform or sling (not shown) can be attached to body member 22 to support operator 50. In this manner, drive ring 16, body member 22, and prime mover system 41 form a motorized turret assembly. U.S. Pat. No. 7,030,579 to Schmitz et al., issued Apr. 18, 2006, entitled "System and method for retrofit mechanism for motorizing a manual turret," is hereby incorporated by reference and describes a motorized turret employing a gear track and body member in a similar manner as to that set forth herein.

Referring further to FIGS. 1 and 2, operator 50 according to one aspect of the present invention actuates user interface 43 to rotate targeting assembly 20 about axis 14 to train targeting equipment 24 in a desired direction. Attaching user interface 43 to targeting equipment 24, allows operator 50 to rotate targeting assembly 20 about axis 14 without having to remove his hands from targeting equipment 24.

Figure 4:
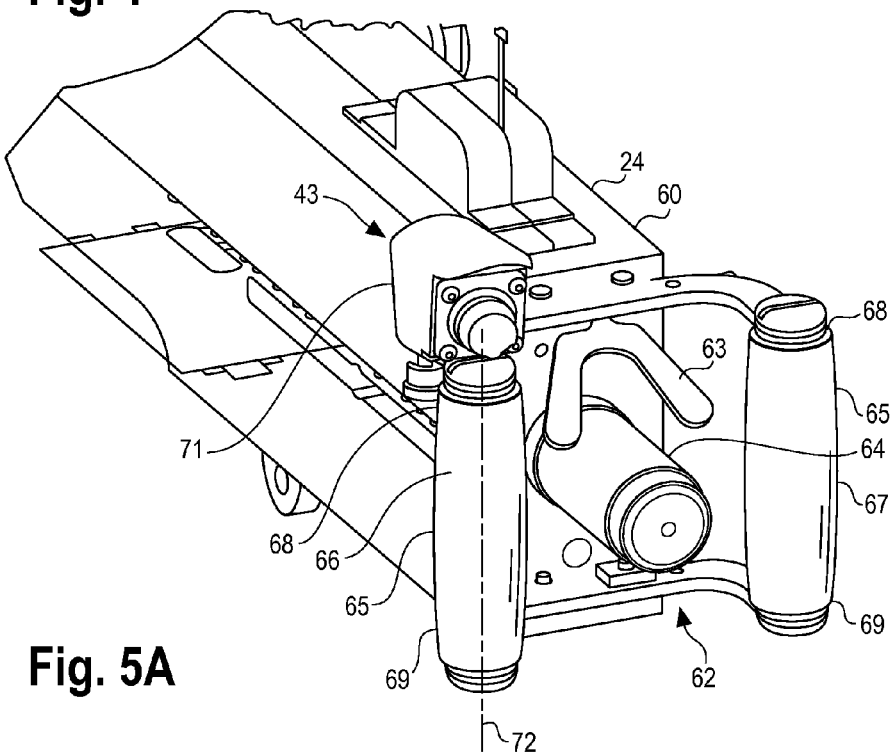
FIG. 4 is a partial perspective view of the weapon shown attached to the targeting assembly in FIG. 1.

Referring to FIG. 4, an exemplary embodiment of targeting equipment 24 is now described for illustrative purposes. Targeting equipment 24 in one example comprises a 50 caliber machine gun 60. Gun 60 includes a handle assembly 62, including a trigger 63, a buffer tube sleeve 64, and at least one grip member 65. In the example shown, gun 60 includes a first generally cylindrical grip member 66 and a second generally cylindrical grip member 67. The first grip member 66 and the second grip member 67 each have a top portion 68 and a bottom portion 69. The first grip member 66 and the second grip member 67 are positioned in a substantially parallel relationship. When using gun 60, the operator 50 grips the first grip member 66 with one hand and grips the second grip member 67 with another hand. User interface 43 is positioned on gun 60 such that operator 50 can rotate targeting assembly 20 without removing a hand from either first grip member 66 or second grip member 67. Operator 50 can fire gun 60 by depressing trigger 63 while rotating targeting assembly 20. Thus, control assembly 40 has two operable conditions: By utilizing user interface 43, system 10 is entered into a first operational mode, in which the targeting assembly 20 is movable about the axis 14 to a secondary firing azimuth, wherein the secondary firing azimuth runs to the general direction at which the operator 50 wants to fire. Then, when the targeting assembly 20 is pointed along the secondary firing azimuth, the operator can utilize the handle assembly 62, in a second operational mode, to move the gun 60 to a primary firing azimuth, wherein the primary firing azimuth runs to the precise target or location at which the operator wants to fire. The operator then fires at the target or location.

Referring further to FIG. 4, user interface 43 in one example comprises a switch mechanism that is capable of proportional control over the slew rate of the targeting assembly 20. The switch mechanism employed in FIG. 4 is a joystick controller 71. FIGS. 6-10 depict alternate embodiments for the switch mechanism, as will be discussed herein. Referring back to FIG. 4, joystick controller 71 is positioned such that it overhangs the top portion 68 of first grip member 66 and extends substantially perpendicular to the axis 72 running through first grip member 66. In one example, joystick controller 71 operates in single axis. The direction the joystick controller 71 is pushed corresponds to the direction of desired travel. The operator 50 can hold first grip member 66 while manipulating joystick with a thumb or finger of the same hand to control the direction of rotation and slew rate of targeting assembly 20 while depressing trigger 63.

Figure 5A:
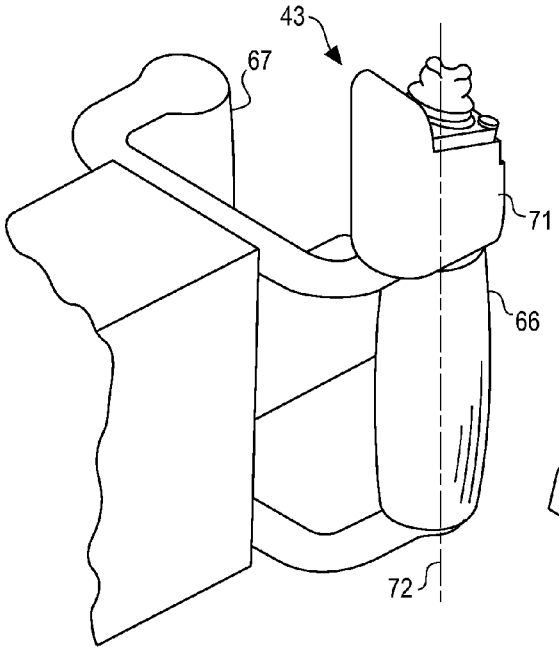
FIG. 5A-FIG. 5B are perspective views of the handle assembly of the weapon shown in FIG. 4.
Figure 5B:
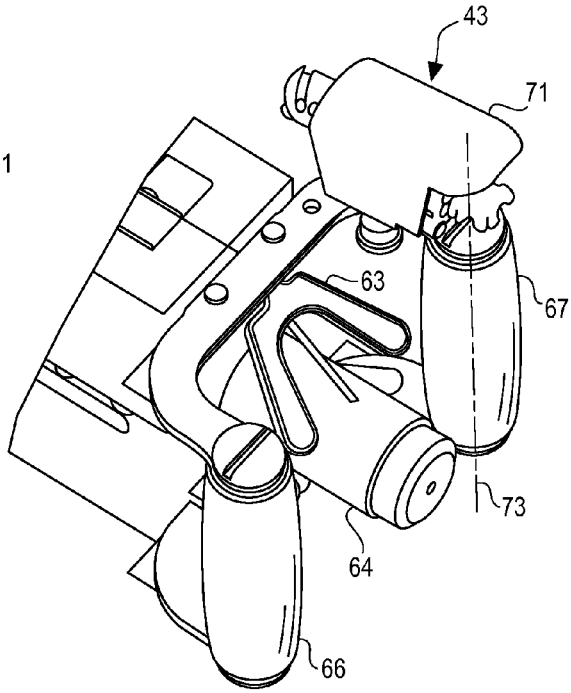

FIGS. 5A and 5B depict additional configurations of joystick controller 71 and gun 60 are now provided for illustrative purposes. In FIG. 5A, joystick controller 71 is again positioned on first grip member 66. The joystick controller 71 extends in a direction parallel to the axis 72 of first grip member 66. In FIG. 5B, joystick controller 71 is positioned on second grip member 67 and extends in a direction perpendicular to the axis 73 of second grip member 67. Joystick controller 71 could also be positioned to extend parallel to the axis 73 of second grip member 67. It should be noted that the embodiments shown in FIGS. 5A and 5B are shown for illustrative purposes and are not meant to be limiting. Joystick controller 71 could be positioned on weapon in various other configurations without departing from the scope defined herein. Further, a multiple axis joystick could be used and various permutations of joystick pushes could be used to select the direction of targeting assembly 20 rotation. For instance, if there were elevation control on gun 60, a joystick push in an x direction could initiate rotation of targeting assembly 20 about a vertical axis and a push in the y direction could cause the targeting assembly 20 and/or the gun 60 to move vertically about the same vertical axis.

Referring to FIG. 6 through FIG. 10, additional embodiments of user interface 43 are now provided for illustrative purposes.

Figure 6:
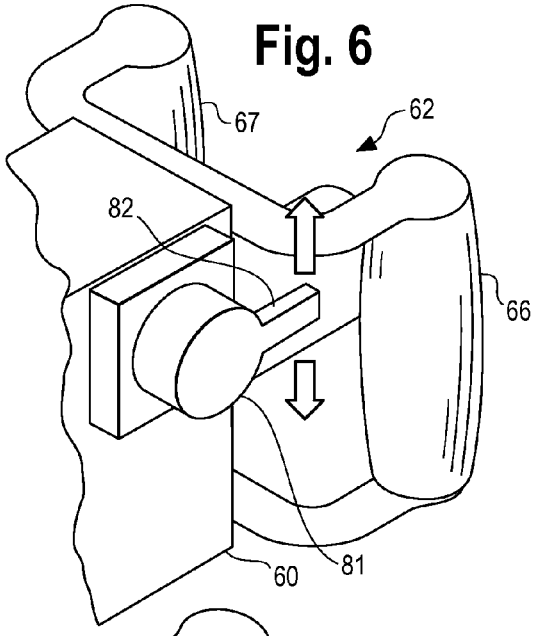
FIGS. 6-10 are alternate embodiments of the handle assembly shown in FIGS. 5A-5B.

FIG. 6 illustrates user interface 43 as a thumb or finger activated proportional control switch 81 on the left side of the gun 60. The operator 50 would be able to use the index or some other convenient finger to push the lever 82 on the control up or down resulting in respective clockwise or counterclockwise rotation of the targeting assembly 20 or vice versa.

Figure 7:
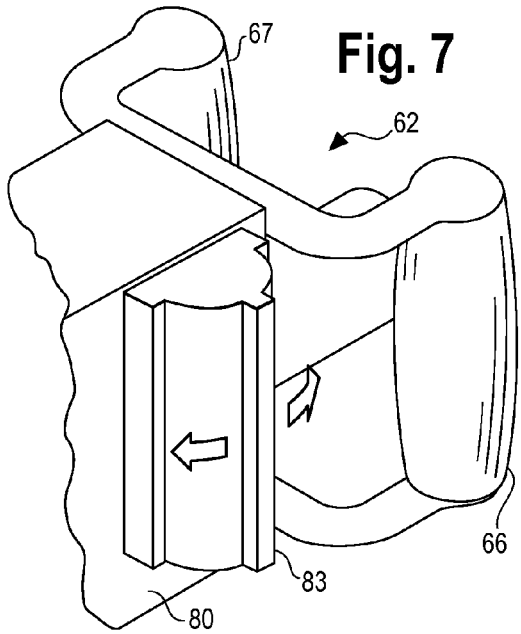

FIG. 7 illustrates an example in which user interface 43 comprises a center biased spring loaded roller bar 83 (up/down rotation) to control the direction and rate of travel of the targeting assembly 20. The roller bar 83 in one example could be mounted proximate to the first grip member 66 on a side of weapon 50.

Figure 8:
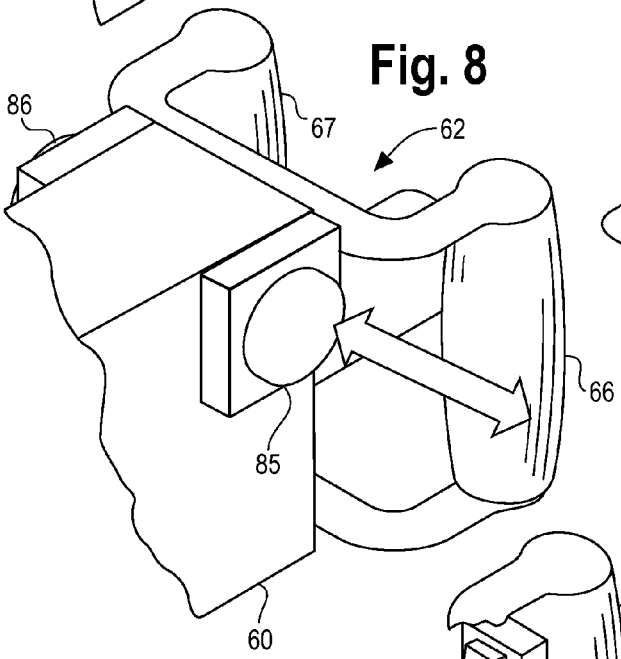

FIG. 8 illustrates an example utilizing a button switch 85 mounted proximate first grip member 66 and another button switch 86 mounted proximate second grip member 67. In one example, by pushing button 85, targeting assembly 20 would rotate clockwise about axis 14 and by pushing button 86, targeting assembly 20 would rotate counter clockwise about axis 14.

Figure 9:
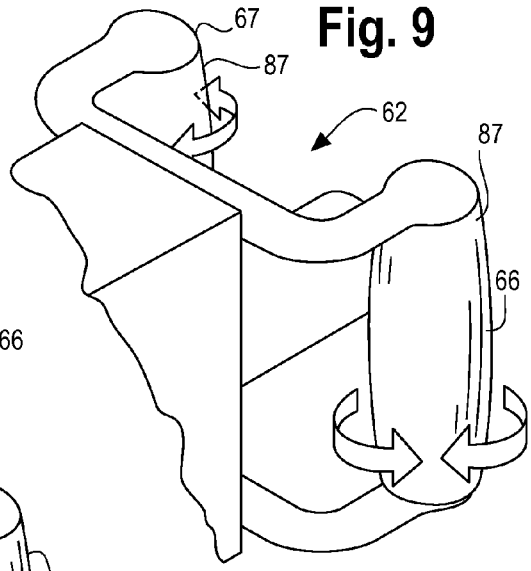

FIG. 9 illustrates yet another embodiment in which user interface 43 comprises twist grips 87 formed by adapting grips 66, 67 for rotational movement around the axes 72, 73 of grip member 66, 67—i.e., in a manner similar to the throttle of a motorcycle. In one example, the twist grips 87 are bi-directional, center spring twist grip, in which the normal position is centered calibrated to zero input. Control assembly 40 responds to twisting movement of grips 87. For instance, by rotating one of the twist grips 87 in a first direction, operator 50 can move targeting assembly 20 clockwise. By rotating the same twist grip 87 in a second direction operator 50 can move targeting assembly 20 counterclockwise. Alternatively, in a manner similar to the embodiment shown in FIG. 6, actuation of one twist grip 87 could be used to rotate the targeting assembly 20 in a first direction, and the other twist grip 87 could be used to rotate the targeting assembly 20 in a second direction.

Figure 10:
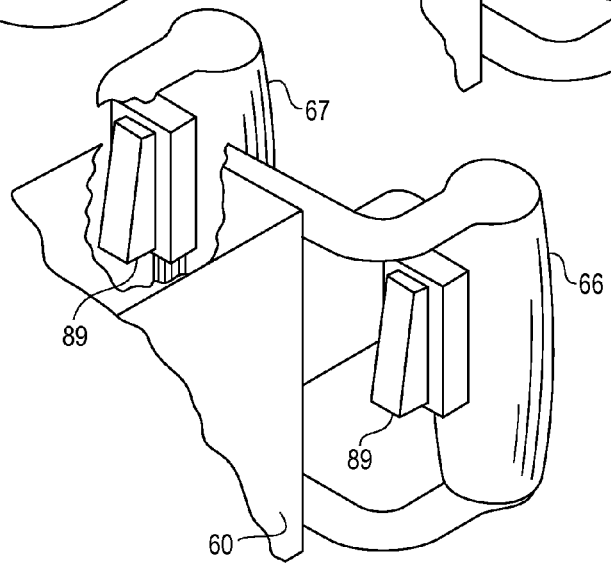

FIG. 10 illustrates a further embodiment in a rocker switch 89 is positioned on each grip 65 and act as user interface 43. By actuating first rocker switch 89, the operator 50 can rotate the targeting assembly 20 in a first direction. By actuating the second rocker switch 89, the operator 50 can rotate the targeting assembly in a second direction. Alternatively, each rocker switch 89 could be used to rotate the targeting assembly in both directions. For instance, each rocker switch 89 would be center sprung. A push of the top portion 89*a* of the switch 89 would rotate targeting assembly 20 in one direction and a push of the bottom portion 89*b* of the switch 89 would rotate the targeting assembly 20 in the other direction. In another instance, a single center sprung rocker switch 89 could be positioned on a single grip and act as a single controller for rotation of targeting assembly 20.

Figure 11:
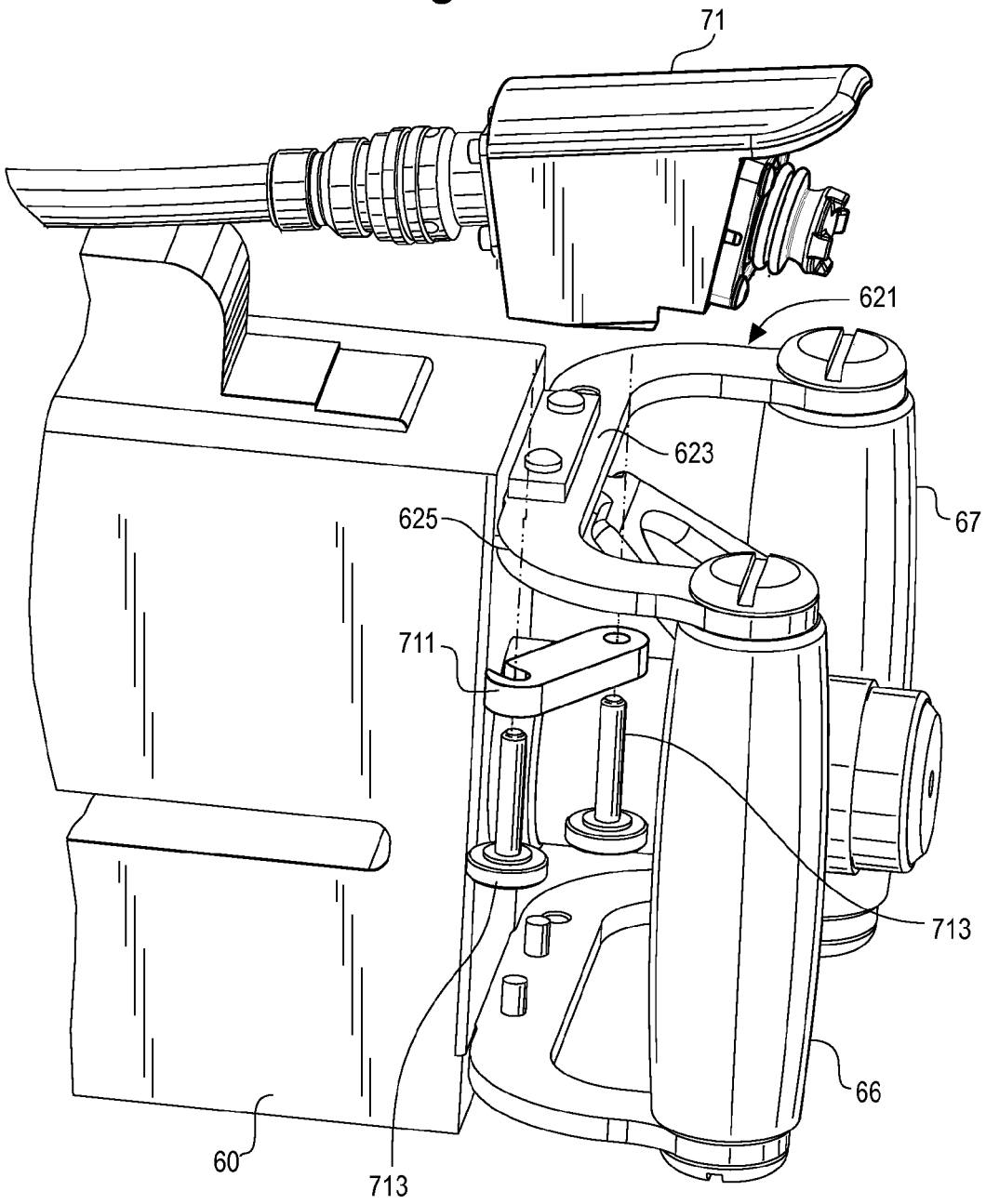
FIG. 11 is an elevated side view of the handle assembly shown in FIG. 4 with the controller and mounting bracket used thereon shown in an exploded orientation.

Referring to FIG. 11, joystick controller 71 in one example attaches to gun 60 through employment of bracket 711. Bracket 711 is positioned under the U-shaped bracket 621 by which grip members 66, 67 are attached to the body of gun 60. In one example, bracket 711 is positioned vertically beneath U bracket 621 and attached to joystick controller 71 through employment of screws 713. Screws 713 cause bracket 711 to bear against U-shaped bracket 621 and hold joystick controller 71 in place against handle assembly 62. In one embodiment, bracket 711 is positioned at a diagonal relative to base 623 of U bracket 621 and at location 625 where the arms of U-shaped bracket 621 meet base 623. Screws 713 are attached to joystick controller 71 in a diagonal configuration. It should be noted that the preceding arrangement has been described for illustrative purposes only. User interface 43 could also be attached to gun 60 through a number of alternative means, such as magnets, adhesives, molding, screws, hook and loop fasteners (e.g. Velcro®), etc.

Figure 11A:
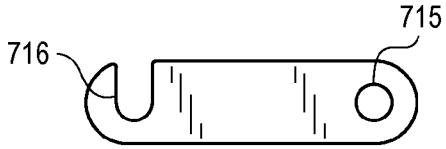
FIG. 11A is an enlarged cut out top view of the clip shown in FIG. 11.

Referring to FIG. 11A, bracket 711 in one embodiment comprises a solid oval shaped frame made of a material, such aluminum, steel, a steel alloy, or a composite material. Bracket 711 includes recesses 715, 716. Recess 715 in one example is a substantially round screw hole and recess 716 is a substantially U-shaped cutout. Such a configuration allows operator 50 to quickly remove joystick controller 71 from handle assembly 62 and reposition it. For instance, if joystick controller 71 were mounted near grip member 66, operator 50 could loosen screw 713 extending through recess 715, rotate bracket 711, and slide the other screw 713 from recess 716. Operator 50 could then reposition joystick controller 71 elsewhere, e.g. on or proximate to grip member 67. The embodiment shown in FIG. 11 is a joystick controller 71. It should be noted, however, that bracket 711 can also be used to attach other embodiments of user interface 43 to handle assembly 62.

Figure 12:
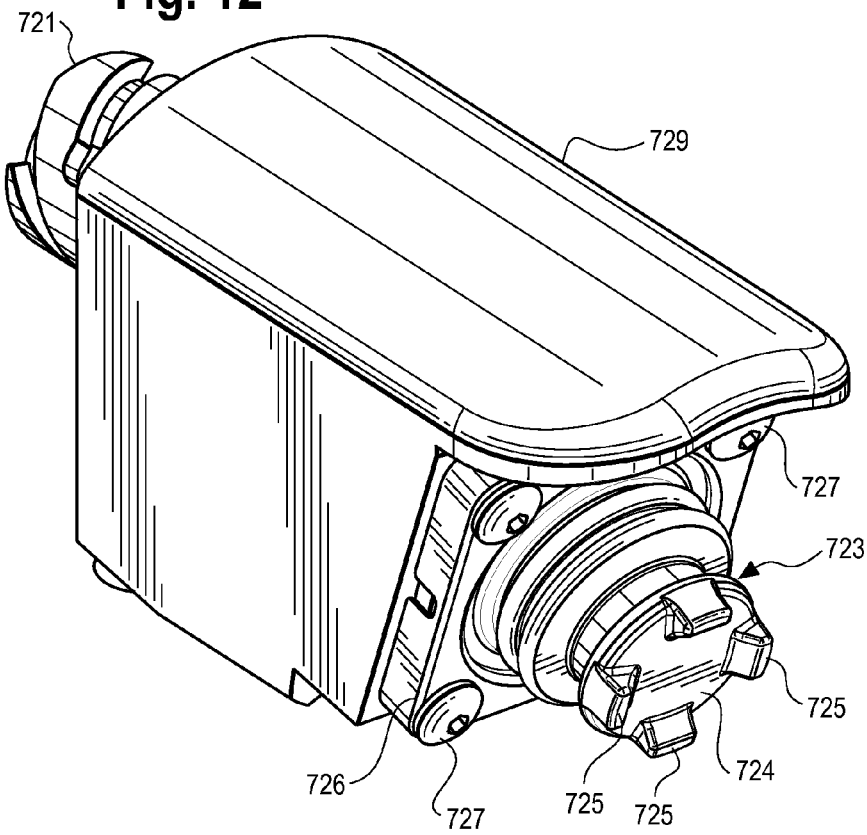
FIG. 12 is a front perspective view of the controller shown in FIG. 11.

Referring to FIG. 12, joystick controller 71 in one embodiment comprises port 721, joystick member 723, and housing 729.

Port 721 in one example is an output port which is attached to control unit 417 through a BPMTU interface connector.

Joystick member 723 in one embodiment is covered with a sheath 724 made of a material, such as rubber, plastic, cloth, etc. Sheath includes at least one instance of projection 725. Projections 725 in one example are shaped like truncated pyramids. Projections 725 provide user with an effective surface against which to bear a thumb or finger to actuate joystick member 723.

Figure 13:
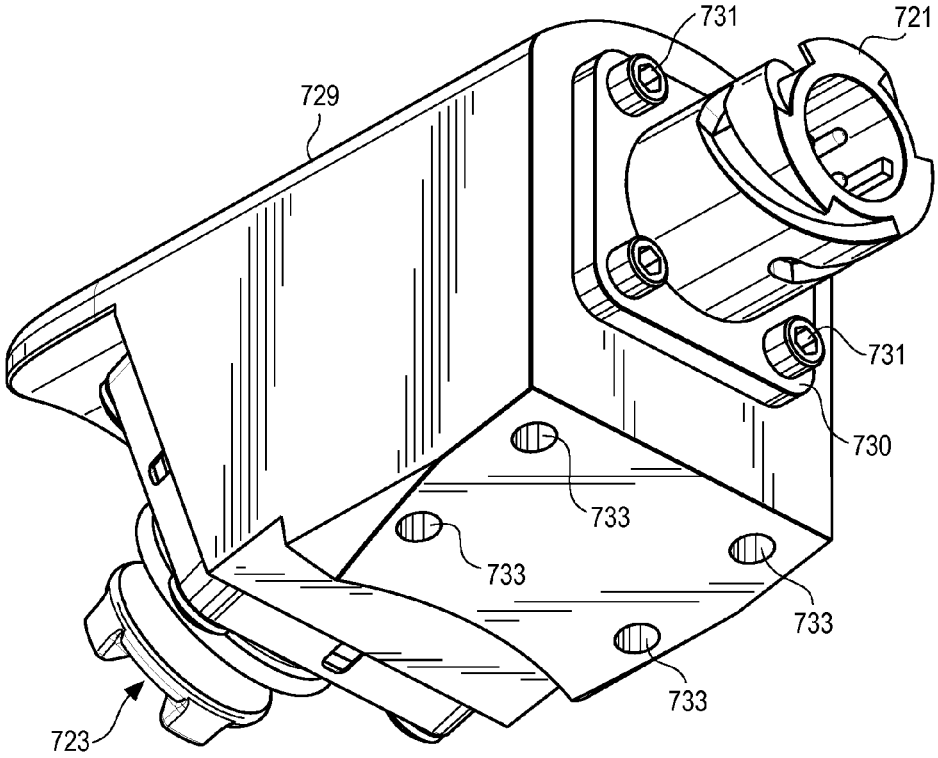
FIG. 13 is a back underside perspective view of the controller shown in FIG. 11.

Referring to FIGS. 11-13, joystick controller 71 is attached to housing 729 through plate 726 and screws 727 (FIG. 11). Port 721 is attached to housing 729 through plate 730 and screws 731. Threaded holes 733 are located on the underside of housing 729 (FIG. 13). Threaded holes 733 receive screws 713 which are employed to attach joystick controller 71 to handle assembly 62.

Figure 14:
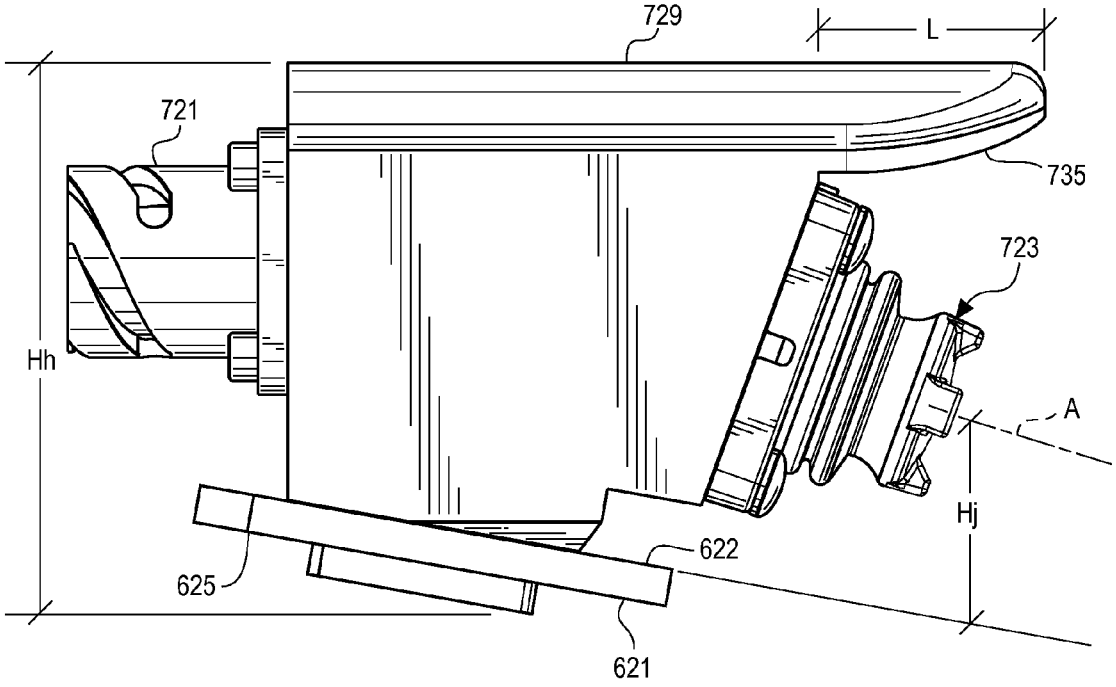
FIG. 14 is an elevated side view of the controller shown in FIG. 11.

Referring to FIG. 14, housing 729 in one embodiment is made of a ruggedized material (e.g. aluminum, steel, steel alloy, a composite material, etc.) and is at least partially hollow such that it can receive at least a portion of joystick member 723 and controller electronics. Housing 729 includes a hood 735 which extends over joystick member 723 and prevents joystick member 723 from being actuated due to inadvertent movement from operator 50.

Referring to FIG. 14, an exemplary orientation for joystick controller 71 to provide operator 50 with an effective reach to joystick member 723 will now be provided for illustrative purposes. In one example, joystick member 723 (FIG. 12) is oriented such that the axis A of the joystick member 723 is oriented downward angle 10 degrees relative to a plane parallel to the top horizontal plane 622 of U-shaped bracket 621 at location 625 (FIG. 11). The height $H_j$ of joystick member 723 (FIG. 12) (to the centroid of that surface) in one example is from −0.25" to 1.0" and optimally at 0.75" from the top horizontal plane 622 of the U-shaped bracket 621 at location 625 (FIG. 11). The height of housing $H_h$ of joystick controller has an exemplary value of 1.5". Finally, a length L of hood 735 has an exemplary value of 0.75". The angle of rotation R of the joystick has an exemplary value of +/−25 degrees from center.

While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A weapons system, comprising:

a frame having an axis;

a targeting assembly including a body member, attached to the frame and arranged for rotational movement relative to the axis, and a weapon; and a control assembly including a user interface mounted on the weapon and operable to rotate the body member about the axis.

2. The weapons system of claim 1, wherein the user interface is a proportional control input device.

3. The weapons system of claim 2, wherein the proportional control input device comprises at least one of a joystick, a twist grip, a rocker switch, a roller bar, and a button switch.

4. The weapons system of claim 1, wherein the weapon comprises a handle assembly, the handle assembly including at least one grip member.

5. The weapons system of claim 4, wherein the at least one grip member comprises a first generally cylindrical grip member and a second generally cylindrical grip member, each having a top portion and a bottom portion, wherein the first generally cylindrical grip member and the second generally cylindrical grip member are positioned in a substantially parallel relationship.

6. The weapons system of claim 5, wherein the user interface comprises a joystick member positioned on the top portion of at least one of the first generally cylindrical grip member and the second generally cylindrical grip member.

7. The weapons system of claim 5, wherein at least one of the first generally cylindrical grip member and the second generally cylindrical grip member is adapted for twisting movement about a vertical axis, and further wherein the user interface is activated by twisting movement of at least one of the first generally cylindrical grip member and the second generally cylindrical grip member.

8. The weapons system of claim 7, wherein the targeting assembly responds to twisting movement of the first generally cylindrical grip member by rotating in a first direction and responds to twisting movement of the second generally cylindrical grip member by rotating in a second direction.

9. The weapons system of claim 5, wherein the user interface comprises a first rocker switch positioned on the first generally cylindrical grip member and a second rocker switch positioned on the second generally cylindrical grip member, wherein the targeting assembly responds to actuation of the first rocker switch by rotating in a first direction and responds to actuation of the second rocker switch by rotating in a second direction.

10. A weapons system, comprising:

a frame having an axis;

a targeting assembly, including a weapon, attached to the frame and arranged for rotational movement relative to the axis;

a control assembly mounted on the frame and the targeting assembly and operable to provide the rotational movement of the targeting assembly about the axis, wherein the control assembly includes a user interface, positioned on the weapon, and operable to move the weapon to a secondary firing azimuth.

11. The weapons system of claim 10, wherein the user interface is a proportional control input device.

12. The weapons system of claim 11, wherein the proportional control input device comprises at least one of a joystick, a twist grip, a rocker switch, a roller bar, and a button switch.

13. The weapons system of claim 10, wherein the weapon comprises a handle assembly, the handle assembly including at least one grip member.

14. The weapons system of claim 13, wherein the at least one grip member comprises a first generally cylindrical grip member and second generally cylindrical grip member, each having a top portion and a bottom portion, wherein the first generally cylindrical grip member and the second generally cylindrical grip member are positioned in a substantially parallel relationship.

15. The weapons system of claim 14, wherein the user interface comprises a joystick member positioned on the top portion of the first generally cylindrical grip member.

16. A weapons system, comprising:

a frame having an axis;

a targeting assembly, including a weapon, attached to the frame and arranged for rotational movement relative to the axis;

a control assembly, including a user interface positioned on the weapon, mounted on the frame and the targeting assembly and operable to provide the rotational movement of the targeting assembly around the axis, wherein the control assembly has two operable conditions, including a first operational mode in which the weapon is movable to a secondary firing azimuth and a second operational mode in which the weapon is movable to a primary firing azimuth, wherein the first operational mode is entered by actuating the user interface.

17. The weapons system of claim 16, wherein the user interface is a proportional control input device.

18. The weapons system of claim 17, wherein the proportional control input device comprises at least one of a joystick, a twist grip, a rocker switch, a roller bar, and a button switch.

19. The weapons system of claim 16, wherein the weapon comprises a handle assembly, the handle assembly including at least one grip member.

20. The weapons system of claim 19, wherein the at least one grip member comprises a first generally cylindrical grip member and second generally cylindrical grip member, each having a top portion and a bottom portion, wherein the first generally cylindrical grip member and the second generally cylindrical grip member are positioned in a substantially parallel relationship.

21. The weapons system of claim 20, wherein the user interface comprises a joystick member positioned on the top portion of the first generally cylindrical grip member.

22. A method of providing a weapons system with weapons mounted rotational control, the weapons system comprising a targeting assembly, including a weapon, and a control unit operable to provide rotational movement of the targeting assembly relative to a frame, the method comprising:

providing a user interface configured to be electromechanically coupled to the control unit;

mounting the user interface on the weapon, and electromechanically coupling the user interface to the control unit.

23. The method of claim 22, wherein the step of providing comprises:

providing a proportional control input device.

24. The weapons system of claim 23, wherein the step of providing the proportional control input device comprises providing at least one of a joystick, a twist grip, a rocker switch, a roller bar, and a button switch.

25. The method of claim 22, wherein the step of providing comprises:

providing the user interface such that it includes a battery powered motorized traversing unit ("BPMTU") interface.

26. The method of claim 22, wherein the weapon includes a handle assembly comprising a first generally cylindrical grip member and a second generally cylindrical grip member, each having a top portion and a bottom portion, wherein the first generally cylindrical grip member and the second generally cylindrical grip member are positioned in a substantially parallel relationship, and wherein the step of attaching the user interface comprises:

attaching the user interface to at least one of the first generally cylindrical grip member and the second generally cylindrical grip member.

27. The method of claim of claim 26, wherein the step of attaching the user interface comprises:

attaching a joystick member to one of the first generally cylindrical grip member and the second generally cylindrical grip member at the top portion thereof.

28. The method of claim 26, wherein the step of attaching the user interface comprises:

adapting at least one of the first generally cylindrical grip member and the second generally cylindrical grip member for twisting movement about an axis.

* * * * *